United States Patent [19]

Kristofek

[11] Patent Number: 4,510,559

[45] Date of Patent: Apr. 9, 1985

[54] LAMP AND FILTER MOUNTING ASSEMBLY

[75] Inventor: Paul J. Kristofek, Hickory Hills, Ill.

[73] Assignee: McGraw-Edison Company, Rolling Meadows, Ill.

[21] Appl. No.: 521,037

[22] Filed: Aug. 8, 1983

[51] Int. Cl.[3] ..... F21V 21/26

[52] U.S. Cl. ..... 362/269; 362/148; 362/287; 362/294; 362/365; 362/368; 362/370; 362/427; 362/430

[58] Field of Search ..... 362/269, 287, 294, 148, 362/365, 368, 370, 427, 430

[56] References Cited

U.S. PATENT DOCUMENTS 2,654,830 10/1953 Runge et al. ..... 362/269

*Primary Examiner*—Stephen J. Lechert, Jr.

*Attorney, Agent, or Firm*—Donald J. Breh; Charles W. MacKinnon; Jon Carl Gealow

[57] ABSTRACT

A lamp and filter mounting assembly includes a lamp holder with a lamp mounting plate and a back wall for pivotal mounting to a bracket. The back wall of the lamp holder includes an inclined adjustment stop that engages the bracket upon rotation of the lamp holder through a predetermined angle. The assembly also includes a filter holder with side rails and a filter stop to hold a filter. The side rails include extensions that overlie the lamp holder to provide a sliding attachment to the lamp holder. The bracket is secured to an aperture pan that is rotatably mounted within a trim assembly. A light shield is secured to the aperture pan and surrounds the lamp holder.

26 Claims, 5 Drawing Figures

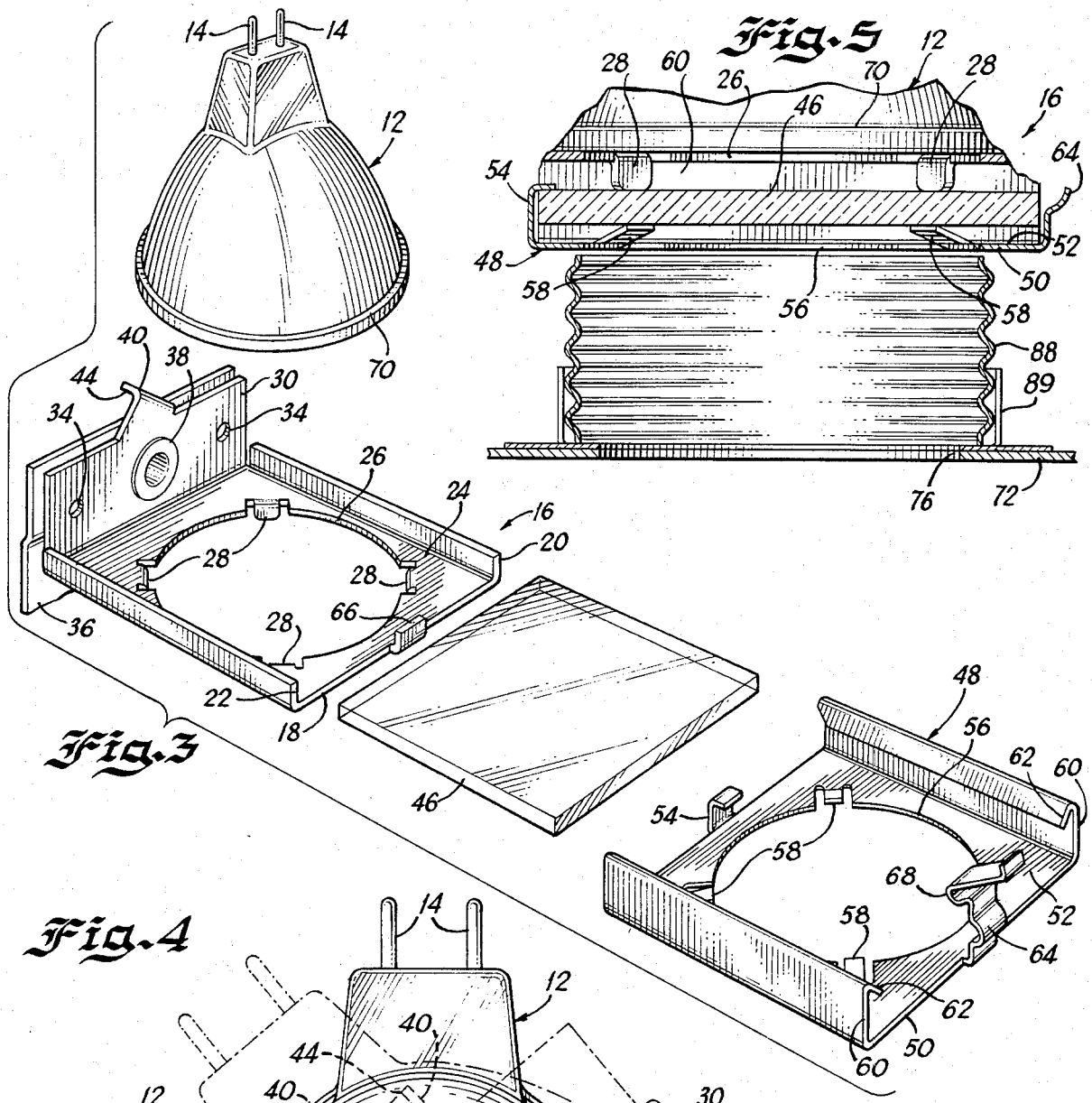
Fig. 5
Fig. 3
14
12
70
40
38
44
30
34
26
24
16
20
28
66
36
22
18
46
48
56
62
60
54
58
68
52
64
50
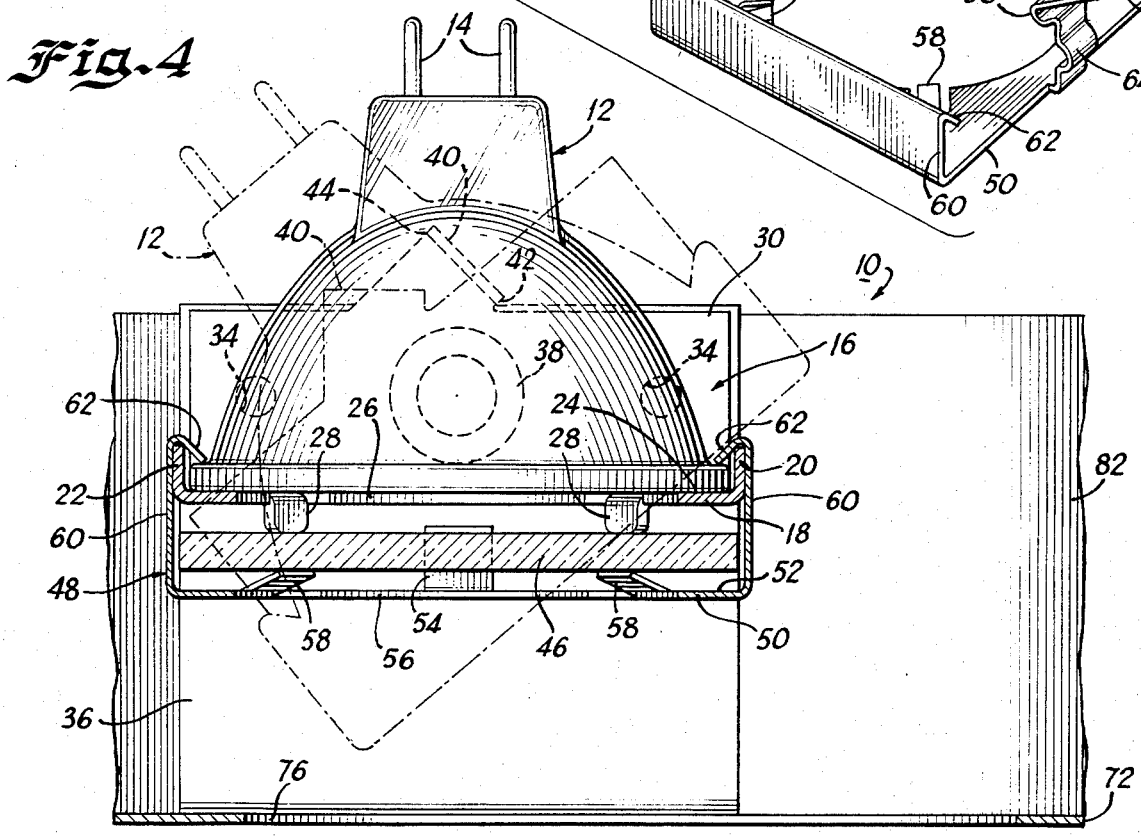
Fig. 4
14
12
40
44
42
30
10
34
38
16
62
26
24
28
20
22
60
18
48
52
58
54
56
46
50
36
76
72
82

LAMP AND FILTER MOUNTING ASSEMBLY

BACKGROUND OF THE INVENTION

The present invention relates to a new and improved lamp and filter mounting assembly and more particularly, to a lamp and filter mounting assembly that can be easily rotated to position a lamp in a selected angular position.

Commercial, theatrical and architectural lighting often employ a spot light or flood beam to illuminate objects or areas. One example of such lighting is a ceiling recess mounted spot light that is used to wash a wall with light or to highlight a painting hung on a wall. The utility of these lights is substantially enhanced if the angular position of the lamp may be varied allowing it to be adaptable to direct light on a wall, a floor or other location without the necessity of moving the light fixture. Since these lights are positioned within a recess in a ceiling or wall, it is also desirable that the lamp can be changed without the necessity of complete disassembly. One solution to these requirements is to provide a light that is not recessed in the ceiling. Such a light is disclosed in U.S. Pat. No. 4,310,870. The light disclosed in this patent takes up room space and may be subjected to damage due to exposure outside the ceiling or wall. Partially recessed lights have also been proposed as illustrated, for example, in U.S. Pat. Nos. 2,554,258; 2,922,030 and 3,300,634. These partially recessed lights also suffer from the disadvantage of being exposed and in some circumstances, from being unsightly and subject to damage. Another alternative has been to position the light within a recess and angularly position a reflecting shade to direct light as desired. Such a light is illustrated in U.S. Pat. No. 2,434,108. This lighting unit although recessed, includes a shade or reflector that must be pulled downwardly out of the recess resulting in the same disadvantages suffered by the lights disclosed in the other patents. A totally recessed light is illustrated in U.S. Pat. No. 2,465,248, but this light cannot be directed to light particular areas.

SUMMARY OF THE INVENTION

An object of the present invention is to provide a new and improved lamp and filter mounting assembly.

Another object of the present invention is to provide a new and improved lamp and filter mounting assembly that includes a self-contained filter.

A further object of the present invention is to provide a new and improved lamp and filter mounting assembly that is easily adjustable.

A still further object of the present invention is to provide a new and improved lamp and filter mounting assembly in which the lamp mounted in the assembly is easily replaced.

Another object of the present invention is to provide a new and improved lamp and filter mounting assembly that can be used in a variety of applications.

Briefly, the present invention is directed to a new and improved lamp and filter mounting assembly for small, reflector type projector lamps. The assembly includes a bracket to which a lamp holder is pivotally secured. The lamp holder includes a lamp mounting plate on which the lamp is positioned. A back wall is secured to the lamp mounting plate and is pivotally mounted onto the bracket. An inclined adjustment stop is defined on the back wall and engages the mounting bracket upon rotation of the lamp holder through a predetermined angle. A filter holder which defines a planar surface on which a filter is mounted may also be included on the assembly. Side rails and a backstop on the holder hold the filter in position. The side rails include inwardly turned extensions allowing sliding attachment of the filter holder to the lamp holder. A latch mechanism is provided to latch the filter holder to the lamp holder. The bracket is secured to an aperture pan that is rotatably mounted on a trim assembly. A light shield surrounds the aperture panel and the entire assembly may be removably positioned within a recessed can in a ceiling or similar structure.

The above and other objects and advantages and novel features of the present invention will become apparent from the following detailed description of a preferred embodiment of the invention illustrated in the accompanying drawings.

BRIEF DESCRIPTION OF THE DRAWINGS

FIG. 3 is a partial, exploded view of the lamp and filter mounting assembly;

FIG. 4 is a view taken along line 4—4 of FIG. 2 illustrating two angular positions of the lamp and filter mounting assembly; and FIG. 5 is a view similar to FIG. 2 illustrating an alternative embodiment.

DESCRIPTION OF THE PREFERRED EMBODIMENTS

Figure 1:
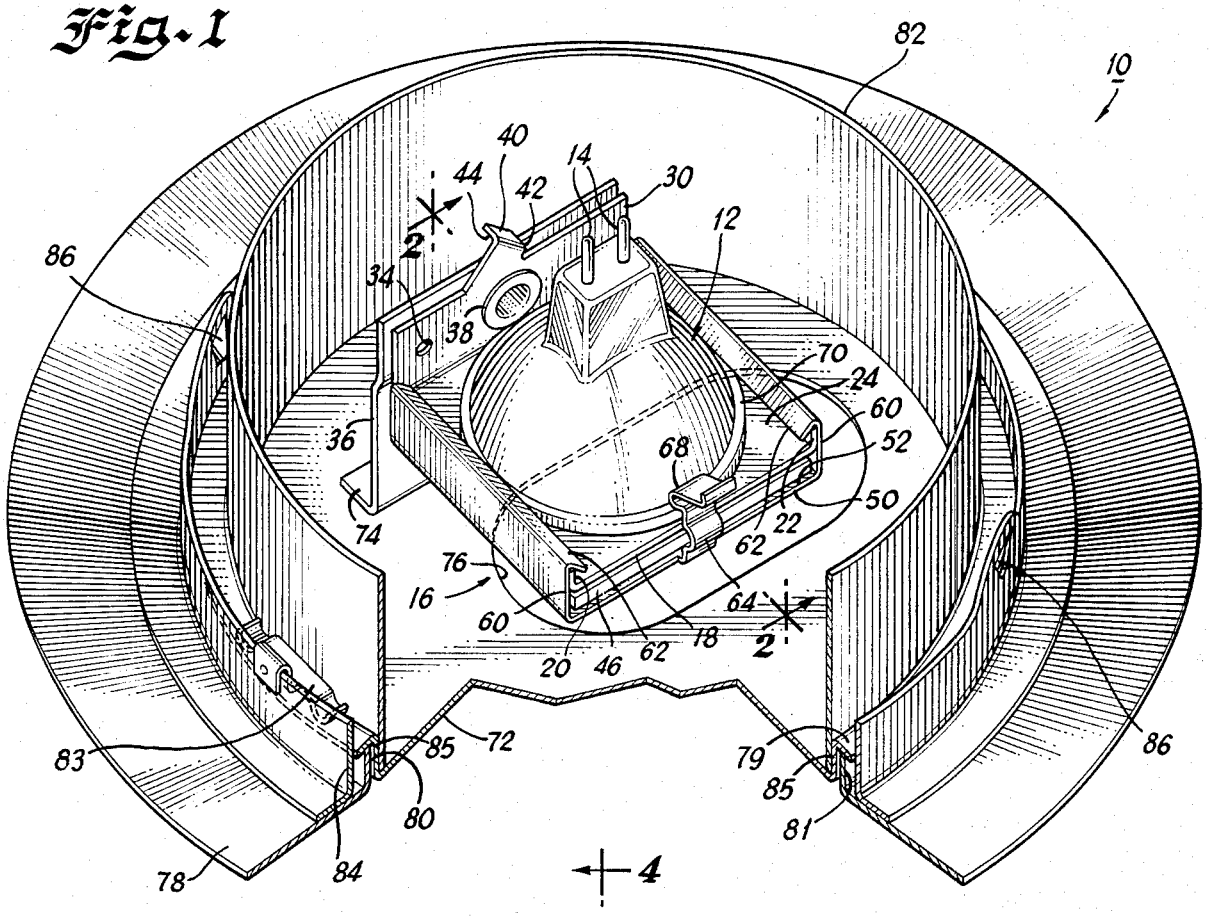
FIG. 1 is a perspective view of a light assembly including a lamp and filter mounting assembly constructed in accordance with the principles of the present invention.

Referring to the drawings and initially to FIG. 1, there is illustrated a light assembly generally designated by the reference numeral 10. Light assembly 10 may be mounted in a can positioned within a recess in a ceiling, wall or similar structure (not shown). The light assembly 10 includes a lamp 12 which may be a flood light or a spot light. Lamp 12 includes terminals 14 which are to be connected to an electrical plug. Assembly 10 is intended to allow directional focusing of lamp 12 in different locations such as a portion of wall adjacent the assembly or a plant or table located beneath the light assembly.

Directional focusing of lamp 12 is accomplished in part by a lamp holder generally designated by the reference numeral 16. Lamp holder 16, as best seen in FIG. 3 includes a bottom wall 18 with parallel side walls 20 and 22. Bottom wall 18 defines a lamp mounting plate 24 on which lamp 12 rests. A central aperture 26 is defined in lamp mounting plate 24 beneath lamp 12. Spacer tabs 28 are fabricated in the rim of aperture 26 and are bent downwardly from lamp mounting plate 24.

Figure 2:
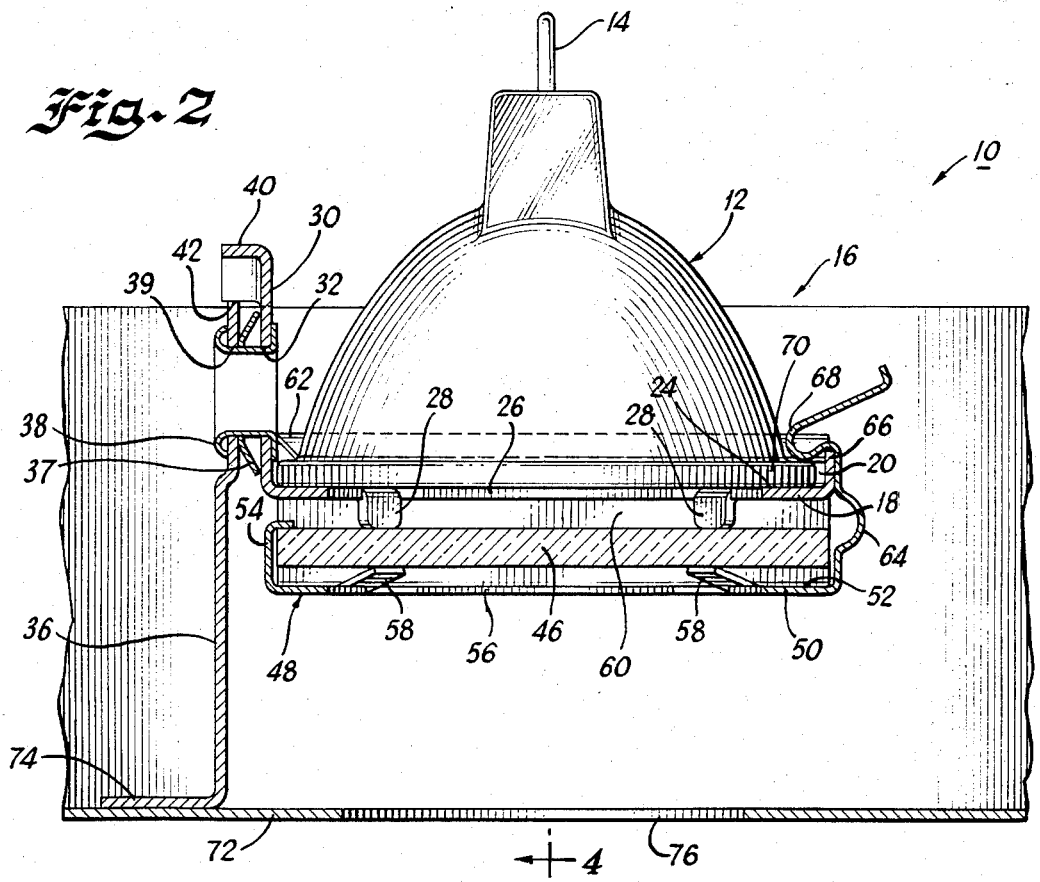
FIG. 2 is an enlarged view taken along line 2—2 of FIG. 1.

Lamp holder 16 includes a rear or back wall 30 with an aperture 32 and rivet holes 34. Back wall 30 may be rigidly secured to a bracket 36 by rivets in rivet holes 34 and through bracket 36. In this fixed position, the lamp 12 and lamp holder 16 may be used as a spot light as in a projector. A preferred procedure, however, is to mount back wall 30 to bracket 36 in such a way as to allow angular rotation or movement of lamp holder 16. This is accomplished with an eyelet 38 secured within aperture 32 and a concentric aperture 39 formed in bracket 36 as best seen in FIG. 2. A spring washer 37 is positioned between the backwall 30 and bracket 36 to provide a tight yet rotatable connection.

Rotation of lamp holder 16 about the axis extending through the centers of apertures 32 and 39 is limited by an inclined adjustment stop 40 formed on the top of wall 30. Stop 40 includes a first edge 42 and a second edge 44. In the substantially horizontal position of lamp mounting plate 24, the first edge 42 abuts the top end of bracket 36. From this position lamp holder 16 may be rotated counter-clockwise, as viewed from the lamp side (see FIG. 4), substantially through a 45° arc until the second edge 44 and the underside of adjustment stop 40 engages the top end of bracket 36. This rotation about the axis extending through the centers of apertures 32 and 39 allows directional focusing of light emanating from lamp 12.

For safety reasons, it is desirable to provide protection from falling hot debris, if lamp 12 were to break or explode. It is also desirable to provide the capability for light assembly 10 to emanate focused, defused or colored light. These features are accomplished throught the use of a filter or lens 46 which may have transparent, translucent or colored, heat resistant glass. Filter 46 as illustrated in the preferred embodiment is square or rectangular, but it is to be understood that filter 46 may be of any desired shape. Filter 46 is held by a filter holder generally designated by the reference numeral 48 that includes a bottom wall 50 defining a filter mounting plate 52. The filter 46 is positioned slightly above the filter mounting plane 52 and held in part by a filter stop 54. A central recess 56 is defined in filter mounting plane 52 and is intended to be aligned with the aperture 26. A plurality of filter tensioning tabs 58 are fabricated in the rim of the aperture 56 and are bent upwardly from plane 52. Additional holding support of filter 46 is provided by side rails 60 which include inwardly and downwardly turned ends 62. Side rails 60 and downwardly turned ends 62 also function to provide sliding attachment of filger holder 48 to lamp holder 16. To join lamp holder 16 and filter holder 48, the inwardly turned ends 62 slide over sidewalls 20 and 22 of lamp holder 16.

As best illustrated in FIGS. 2 and 4, in the assembled position, spacer tabs 28 engage the upper surface of filter 46 providing a space between the bottom wall 18 of lamp mounting plate 24 and filter 46. Filter 46 is biased upwardly against spacer tabs 28 by the tension tabs 58 to thereby provide a space between filter 46 and bottom wall 52. The spaces above and below filter 46 allow air circulation to disipate heat and also provide compensation for variances in the thickness of the glass of filter 46 and for heat expansion of filter 46.

Once assembled, filter holder 48 is locked to the lamp holder 16 by a latch 64 and a latch tab 66. In the assembled position, latch 64 extends over and locks onto tab 66. Rim 70 is engaged by the downward extending ends 62 of side rails 60 which also serve to captivate lamp 12, thereby holding it onto the lamp mounting plate 24.

Lamp holder 16, filter holder 48 and bracket 36 are secured to an aperture pan 72 by spot welding or attaching by other means a leg 74 of bracket 36 to pan 72. Aperture pan 72 includes an elongated elliptical aperture 76. As best illustrated in FIG. 1, one end of the aperture 76 is directly below lamp 12 when the lamp mounting plate 24 is in a parallel horizontal position. The opposite end of aperture 76 is located to allow the passage of light emanating from lamp 12 in its most inclined position with end 44 of adjustment stop 40 engaging the top of bracket 36. Aperture pan 72 is loosely positioned within a trim member 78 which may be of a circular, dish shape with a central aperture 80 of a diameter slightly smaller than the outside diameter of aperture pan 72. Aperture pan 72 includes a flange 79 which is positioned to rest upon an upstanding rim 81 of trim member 78 along aperture 80. Flange 79 is held onto rim 81 by one or more clips 83. This positioning of aperture pan 72 on trim member 78 allows aperture pan 72 and attached lamp holder 16, filter holder 48 and lamp 12 to be rotated relative to trim member 78 to thereby provide additional directional aiming.

Aperture pan 72 is encircled by a light shield 82 that is slideably positioned within an upstanding wall 85 defined on aperture pan 72 below flange 79. Light shield 82 may be dark in color to provide a pleasing appearance if one were to look through aperture 76. Light shield 82 is removable allowing ready access to lamp 12 for replacement, and if necessary, to latch 64 to release filter holder 48 from lamp holder 16. Upstanding wall 84 includes ears 86 to which torsion springs (not shown) or similar devices may be secured for attachment of the light assembly 10 to a can mounted in a recess in a ceiling or similar structure.

It may be desirable to provide a pin hole spot light using the light assembly 10. This may be accomplished by positioning a baffle 88 between filter holder 48 and aperture pan 72 (FIG. 5). Baffle 88 is removably held by a tight fit within a holder 89 which is spot welded or otherwise attached to aperture pan 72. Baffle 88 provides a spot light effect while also providing a aesthetic appearance upon viewing of light assembly 10 through aperture 76.

I claim:

1. A lamp mounting assembly, comprising:

a lamp, a lamp holder defining a planar lamp mounting plate, an aperture in said mounting plate to allow the passage of light therethrough, a substantially vertically inclined back wall on said lamp holder, a substantially vertically inclined mounting bracket with a portion thereof being substantially flat and co-extensive with said back wall, and means for rotatably mounting said back wall of said lamp holder to said mounting bracket, to permit rotation of said lamp holder on said mounting bracket.

2. The assembly claimed in claim 1, wherein said back wall includes an adjustment stop to thereby limit the rotation of said back wall of said lamp holder with respect to said mounting bracket.

3. The assembly claimed in claim 2 wherein said adjustment stop is inclined at approximately 45° relative to said lamp mounting plate.

4. The assembly claimed in claim 1, further comprising a filter holder, said filter holder including a planar filter mounting member with side rails, said planar filter mounting member having an aperture and including means for holding said lamp on said lamp holder.

5. The assembly claimed in claim 4 wherein said filter holder includes means for releasably latching said filter holder to said lamp holder.

6. The assembly as claimed in claim 1, further comprising means for mounting said mounting bracket which includes an aperture pan secured to said mounting bracket, said aperture pan including an elliptical aperture to allow the passage of light from said from said lamp therethrough.

7. The assembly as claimed in claim 6, wherein said means for mounting said mounting bracket further includes a trim assembly, said aperture pan being rotatably mounted in said trim assembly.

8. The assembly claimed in claim 6, further comprising a baffle mounted on said aperture pan aligned with said aperture in said lamp mounting plate and said aperture in said aperture pan.

9. A lamp mounting assembly, comprising:

a lamp a mounting bracket, a lamp mount including a planar lamp holder with a back wall, means for mounting said back wall on said mounting bracket, a filter holder including a planar filter mounting member, means for releasably mounting said filter holder on said lamp mount, means on said filter holder for securing a filter means, and means for holding a lamp on said planar lamp holder.

10. The lamp mounting assembly set forth in claim 9, further comprising aligned apertures in said planar lamp holder and said planar filter mounting member.

11. The lamp mounting assembly set forth in claim 9, wherein said means for mounting said back wall onto said mounting bracket allows rotation of said lamp mount relative to said mounting bracket.

12. The lamp mounting assembly set forth in claim 9, further comprising an inclined adjustment stop on said back wall, said means for mounting said back wall onto said mounting bracket providing a rotatable connection between said back wall and said mounting bracket, said stop being positioned to engage said bracket upon rotation of a predetermined number of degrees by said lamp mount.

13. The lamp mounting assembly set forth in claim 9, wherein said means for mounting said back wall onto said mounting bracket permanently affixes said lamp mount to said mounting bracket.

14. The lamp mounting assembly set forth in claim 9, further comprising an aperture pan secured to said mounting bracket, said aperture pan including an elliptical aperture.

15. The lamp mounting assembly set forth in claim 9, further comprising an aperture pan secured to said mounting bracket, a trim pan, said aperture pan rotatably positioned within said trim pan.

16. The lamp mounting assembly as set forth in claim 15, further including a baffle between said aperture pan and said filter mount.

17. A lamp and filter mounting assembly, comprising:

a lamp, a trim member including an aperture, an aperture pan positioned to rest substantially within said aperture in said trim member, said aperture pan also including an aperture, a mounting bracket secured to said aperture pan, a lamp holder including a planar lamp mounting plate and a wall on one side of said lamp mounting plate, means for securing said wall to said mounting bracket, side walls on said lamp mounting plate, a filter holder including means for slideable attachment of said filter holder to said lamp holder, said filter holder also including means for holding said lamp onto said lamp mounting plate, and means on said filter holder for holding a filter.

18. The assembly as claimed in claim 17 further comprising an adjustment stop on said wall in a position to engage said mounting bracket in a predetermined angular position of said lamp holder relative to said mounting bracket.

19. The assembly claimed in claim 17, further comprising spacer means for maintaining a space between said lamp holder and said filter holder.

20. The assembly claimed in claim 17, further including tensioning means to suspend said filter in a predetermined position.

21. The assembly claimed in claim 17, further comprising a baffle between said aperture pan and said filter holder.

22. The assembly as claimed in claim 17, wherein said means for holding said lamp includes side rails on said filter holder with extensions extending over said side walls on said lamp mounting plate.

23. The assembly claimed in claim 17, further comprising a light shield on said aperture pan surrounding said lamp holder.

24. The assembly claimed in claim 17, wherein said aperture pan is rotatably positioned in said aperture of said trim member.

25. The assembly claimed in claim 17 wherein said filter may focus light from said lamp.

26. The assembly claimed in claim 17 wherein said filter allows passage of a greater portion of light of a particular color from said lamp.

* * * * *